United States Patent [19]

Dooley et al.

[11] 4,318,160

[45] Mar. 2, 1982

[54] FLUORESCENT LAMP CONVERSION UNIT

[75] Inventors: Thomas E. Dooley, Clifton; Edward W. Morton, Teaneck, both of N.J.

[73] Assignee: Westinghouse Electric Corp., Pittsburgh, Pa.

[21] Appl. No.: 98,107

[22] Filed: Nov. 28, 1979

[51] Int. Cl.[3] ..... F21S 5/00

[52] U.S. Cl. ..... 362/216; 362/260; 362/410

[58] Field of Search ..... 362/216, 217, 260, 410

[56] References Cited

U.S. PATENT DOCUMENTS

| | | | |
|---|---|---|---|
| 2,697,777 | 12/1954 | Rosa | 362/216 |
| 2,817,004 | 12/1957 | Baumgartner | 362/216 |
| 3,742,208 | 6/1973 | Mills | 362/216 |

OTHER PUBLICATIONS

Dale et al., Lighting Design & Application, Mar. 1976 Edition, pp. 18–23.

*Primary Examiner*—Donald P. Walsh

*Attorney, Agent, or Firm*—R. S. Lombard

[57] ABSTRACT

A fluorescent lamp conversion unit for use in combination with the residential incandescent-type lamp fixture. The fixture is of the type intended for operation with a lamp shade of predetermined dimensions. The fluorescent lamp conversion unit includes lamp and lamp shade supporting means including a rigid hollow elongated member for supporting a fluorescent lamp of the compact type having an elongated envelope which has a double-U-bend to present a compact design thereby enabling the lamp to be enclosed by the lamp shade.

4 Claims, 6 Drawing Figures

FLUORESCENT LAMP CONVERSION UNIT

CROSS-REFERENCE TO RELATED APPLICATION

In copending application Ser. No. 11,836, filed Feb. 13, 1979, filed by Inga Hoeh, Executrix of the Estate of Frederick W. Hoeh, Deceased, and owned by the present assignee, is disclosed a fluorescent lamp having a double U-bent envelope.

BACKGROUND OF THE INVENTION

This invention relates to a fluorescent lamp conversion unit and, in particular, to a fluorescent lamp conversion unit for use in combination with a residential incandescent-type lamp fixture.

It is well known that a fluorescent lamp lighting system is more efficient than an incandescent lamp lighting system by a factor of three to four or more for equivalent illumination. In the past, however, fluorescent lamps have not been used for indoor residential lighting because of their poor color rendition compared to incandescent lighting. In recent years, however, fluorescent lamps are available with a color rendition comparable to incandescent. A number of conversion units have been disclosed to convert residential incandescent lighting fixtures to fluorescent. One such conversion unit is disclosed in U.S. Pat. No. 2,817,004 dated Dec. 17, 1957 issued to Baumgartener, et al. This patent discloses a combined adapter and holder for circular tubular fluorescent lamps. The combined adapter holder is mountable on existing light fixtures designed for incandescent lamps equipped for screw-type bases. The plane of the circular lamp envelope is parallel to the direction in which the screw-type socket opens.

Another such lamp conversion unit is disclosed in U.S. Pat. No. 2,697,777 dated Dec. 21, 1954, issued to Ercole Rosa. This patent describes a lamp adapter comprising a body including a first section and a second section. A circumferential ring on the body is secured to the first section and second section, thereby securing the first section to the second section. A plurality of circumferentially spaced grooves in the body and the plurality of brackets are included, the brackets have hooked portions detachably engaged in the grooves between the ring and the body. The brackets have accurate free-end portions adapted to support a circular fluorescent lamp.

In an article appearing in *Lighting Design and Application,* March 1976 Edition entitled "Conversion of Incandescent Lamp Sockets to Fluorescent in the Home Market" by E. A. Dale, a retrofit lighting system for converting incandescent fixtures to fluorescent is described. In FIG. 5 of the article is shown a solid-state ballast mounted within the periphery of the harp of a table lamp. A circular, tubular fluorescent is supported around the harp with its axis in the vertical plane.

SUMMARY OF THE INVENTION

This invention provides a fluorescent lamp conversion unit for use in combination with a residential incandescent-type lamp fixture. The residential incandescent-type lamp fixture comprises a base member having electrical conductors associated therewith. Socket means vertically project from the upper portion of the base member and operatively receive the electrical conductors. The incandescent-type lamp fixture is intended for operation with a lamp shade of predetermined dimensions and has a supporting frame means proximate the upper end thereof which includes a central member having provided therein an aperture of predetermined size.

The fluorescent lamp conversion unit comprises lamp and lamp shade supporting means comprising a rigid hollow elongated member adapted to be vertically disposed and having at the lower end thereof an electrical adapter means adapted to mountably engage the socket means. The lamp and lamp shade supporting means has at the upper end thereof a support member extending colinearly from the hollow elongated member and adapted to project through the aperture provided in the central member of the lamp shade frame means to support the lamp shade.

A retaining member is provided and is sized to cooperate with the support member to secure the frame means of the lamp shade to the hollow elongated member. Housing means is affixed to the hollow elongated member proximate at one or the other end thereof. A fluorescent lamp of the compact type is supported by the hollow elongated member. The compact lamp has an elongated envelope which has a double-U-bend to present a compact design thereby enabling the lamp to be enclosed by the lamp shade. The lamp includes a pair of thermionic electrodes operatively mounted within the envelope proximate the ends thereof. A pair of lead-in conductors is sealed through each end of the envelope and connect to each of the electrodes. The envelope encloses a discharge-sustaining filling and has phosphor material carried on the interior surface thereof. The ends of the lamp terminate within the housing means. Current carrying conductor means is connected in circuit between the electrodes and the electrical adapter means. Lamp starting and ballasting means are connected in circuit with the fixture to operate the lamp.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENT

Figure 1:
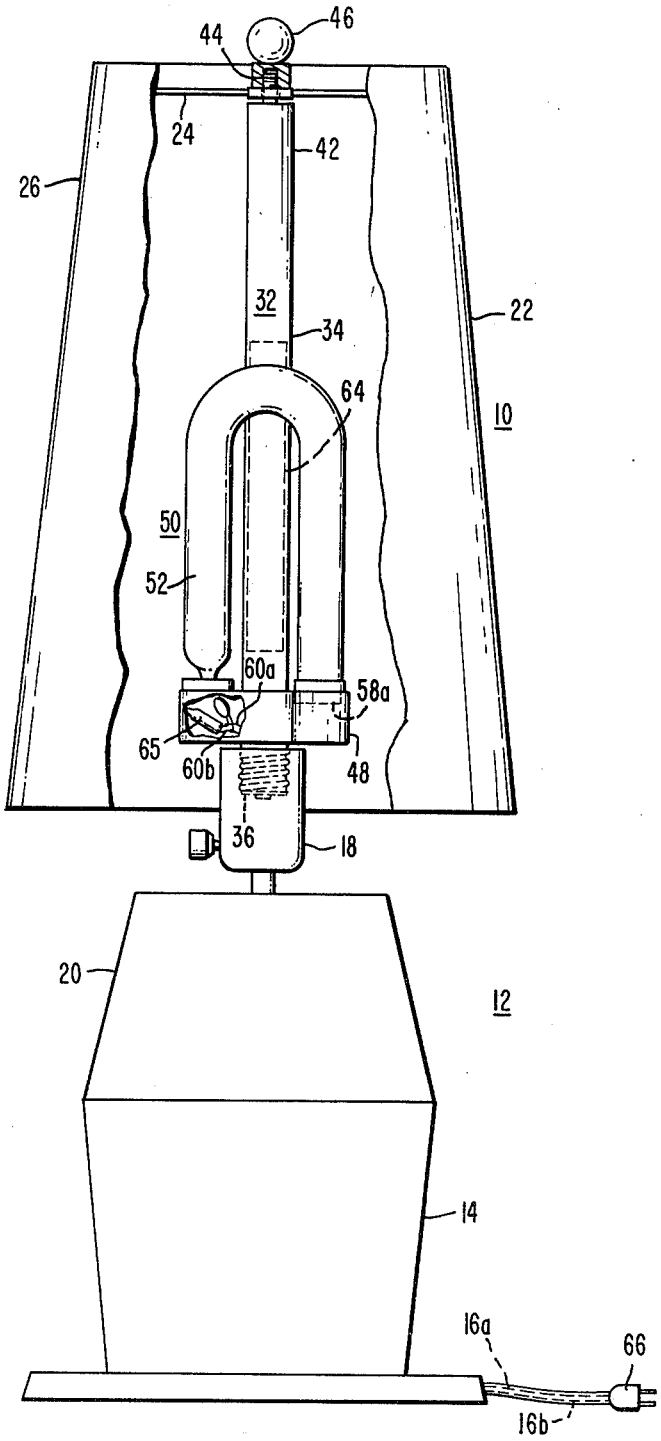
FIG. 1 is an elevational view, partly in section, showing the fluorescent lamp conversion unit of the present invention containing integral ballasting means and a double-U-bend fluorescent lamp mounted on a residential incandescent-type lamp fixture.
Figure 2:
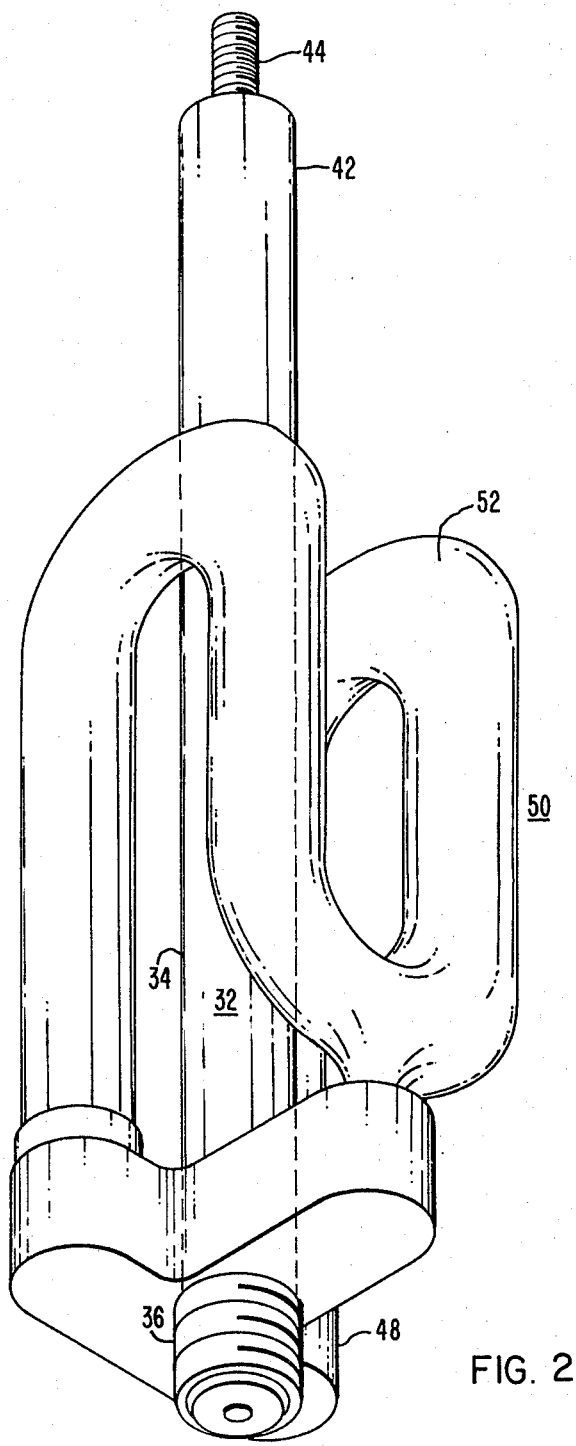
FIG. 2 is an isometric view, partly in section, showing the fluorescent lamp conversion unit of FIG. 1.
Figure 3:
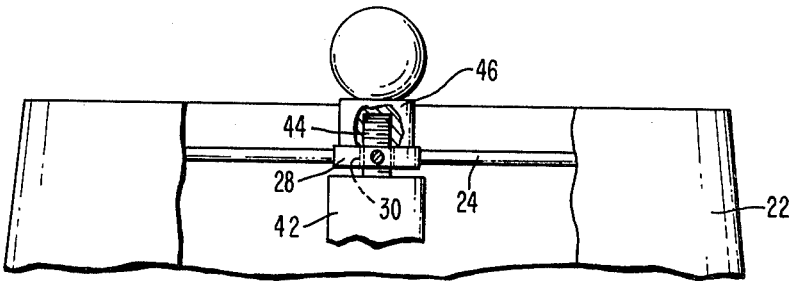
FIG. 3 is an enlarged elevational view, partly in section, showing details of the mounting of the lamp shade on the lamp and lampshade supporting means.
Figure 4:
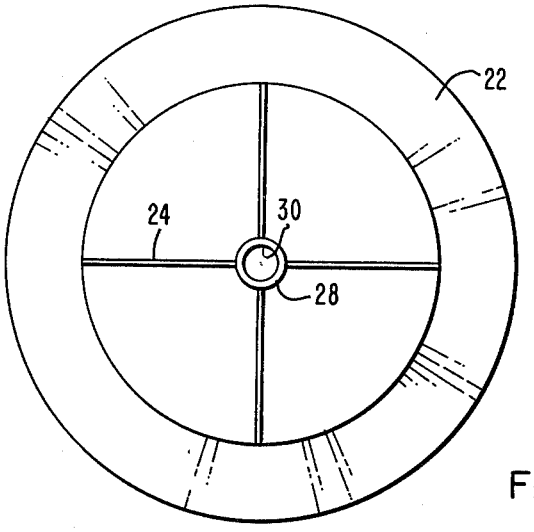
FIG. 4 is a plan view of the lamp shade.

In FIGS. 1 and 2 is shown a fluorescent lamp conversion unit 10 for use in combination with a residential incandescent-type lamp fixture 12 shown in FIG. 1. Fixture 12 typically comprises a base member 14 of predetermined size, shape and material as is well known in the art. Base member 14 has electrical conductors 16*a*, 16*b* associated therewith. Socket means 18 is provided vertically projecting from the upper portion 20 of the base member 14 and operatively receiving the electrical conductors 16*a*, 16*b*. The fixture 12 is intended for operation with a lamp shade 22 of predetermined dimensions, such as 7.0 inches (17.78 cm.) top and bottom diameter and 14.0 inches (35.56 cm.) in height and the lamp shade 22 has a supporting frame means 24 proximate the upper end 26 thereof. The supporting frame 24 is typically made of a metal such as steel and includes a central member 28, see FIGS. 3 and 4, having an aperture 30 provided therein of predetermined size such as 7/16 inches (1.111 cm.).

The fluorescent conversion unit comprises a lamp and lamp shade supporting means 32 comprising a rigid hollow elongated member 34 adapted to be vertically disposed and having at the lower end thereof an electrical adapter means 36 adapted to mountably engage the socket means 18. The supporting means 32 has at the upper end 42 thereof a support member 44 extending colinearly from the hollow elongated member 34. The support member 44 is adapted to project through the aperture 30 provided in the central member 28, see FIG. 3, of the lamp shade supporting frame 24 to support the lamp shade 22. A retaining member 46 is sized to cooperate with the support member 44 to secure the frame means 24 of the lamp shade 22 to the hollow elongated member 34. Housing means 48 is affixed to the hollow elongated member 34 proximate at one or the other end thereof. The lamp 50 has an elongated envelope 52 which has a double-U-bend to present a compact design thereby enabling the lamp 50 to be enclosed by the lamp shade 22. The envelope 52 of the compact lamp 50 shown in FIGS. 1 and 2 has a double-U-bend which readily fits within the lamp shade 22.

Figure 5:
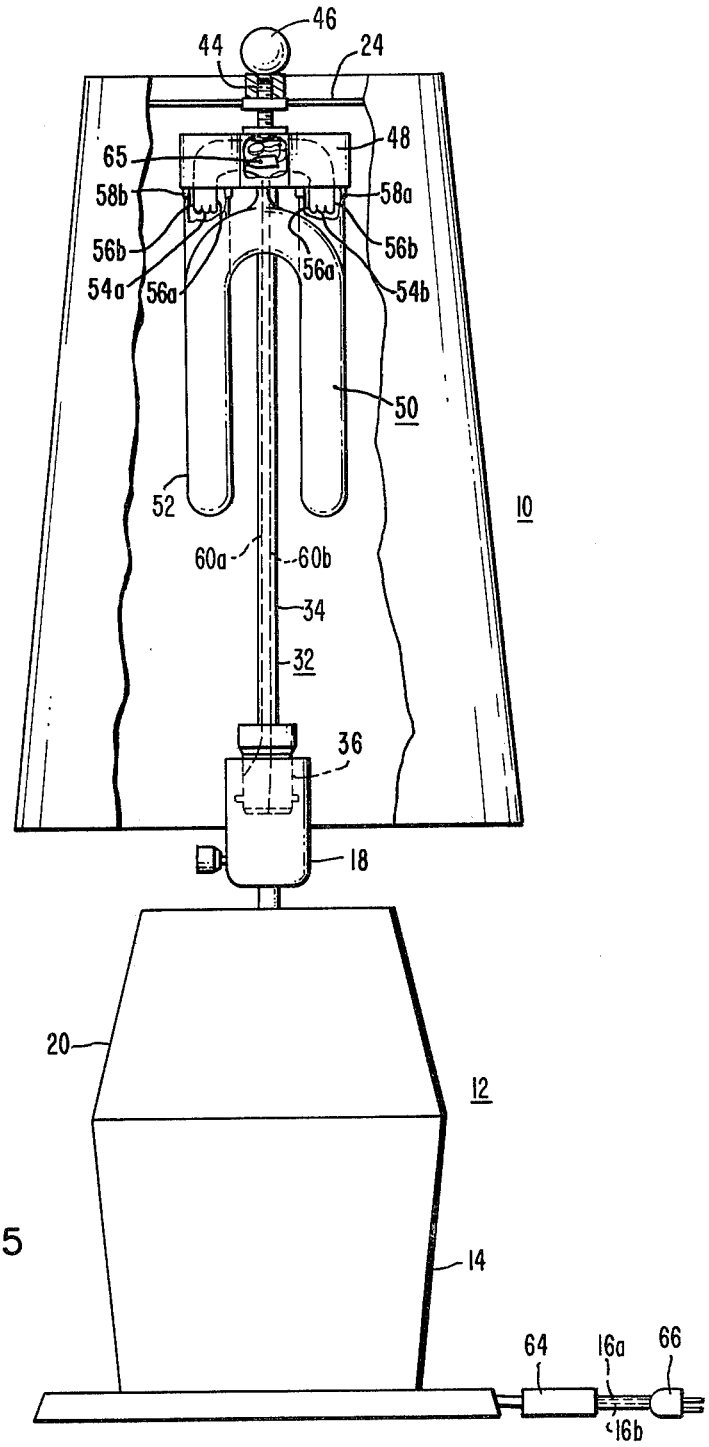
FIG. 5 is an elevational view partly in section, showing a fluorescent lamp conversion unit of the present invention mounted on a residential incandescent-type lamp fixture with an external ballasting means; and, FIG. 6 is a schematic diagram of the electrical circuit of the lamp starting and ballasting means.

The lamp 50 includes a pair of thermionic electrodes 54*a*, 54*b*, see FIG. 7. A pair of lead-in conductors 56*a*, 56*b*, see FIG. 5 are sealed through each end of the envelope 50 and connected to each of the electrodes 54*a*, 54*b*. The envelope 52 encloses a discharge-sustaining filling of mercury and a small pressure of inert ionizable starting gas, for example, and has phosphor material such as a blend as disclosed in U.S. Pat. No. 3,858,082 dated Dec. 13, 1974 carried on the interior surface thereof. The ends 58*a*, 58*b* of the lamp terminate within the housing 48. Current carrying conductor means 60*a*, 60*b*, are connected in circuit between the electrodes 54*a*, 54*b* and the electrical adapter means 36.

Figure 6:
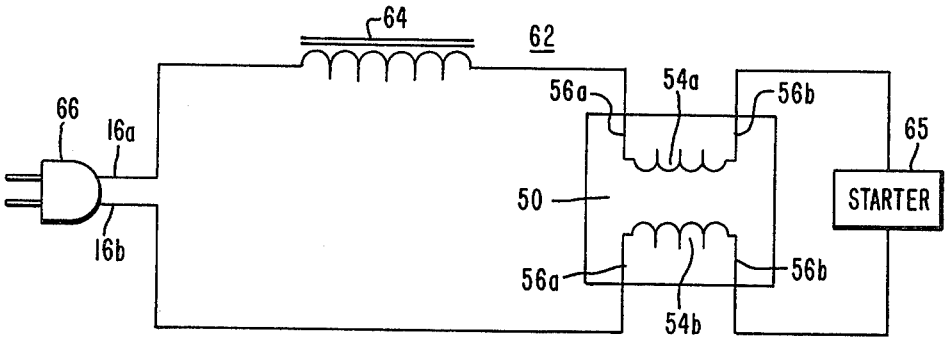

Referring to FIG. 6 for wiring details, lamp starting and ballasting means 62 comprising ballast 64 and starter 65 are connected in circuit with electrical conductor 16*a*, 16*b* to operate the lamp 50. The fluorescent lamp conversion unit 10 as shown in FIG. 1 contains integral lamp starting and ballasting means 62, with the ballast 64 enclosed within the rigid hollow elongated member 34 and the starter 65 enclosed within housing 48. With this arrangement the electrical adapter 36 is preferably a screw-type base and the socket 18 is then the "standard" screw-type socket.

In FIG. 5 is shown an alternative embodiment of the present invention with like numbers representing like parts. In this embodiment the housing 48 is affixed to the lamp and lamp shade supporting means 32 at the upper end thereof. Current carrying conductors 60*a*, 60*b* extend from the electrical adapter 36 through the rigid hollow elongated member 34 to connect in circuit with the lead-in conductors 56*a* at each end 58*a*, 58*b* of the lamp 50. In this embodiment the lamp ballast is mounted externally of the fluorescent conversion unit 10, which as shown in FIG. 5 is mounted outside of the base 14 of the fixture 12 in circuit with the plug 66. The starter 65 may be mounted within the housing 48, as shown. The electrical adapter 36 of this embodiment is preferably a bayonet-type base so that it may not be readily mountable in a standard screw-socket to prevent the possibility of the lamp 50 from being operated without a ballast and the socket 18 is also of the bayonet type.

We claim:

1. A fluorescent lamp conversion unit for use in combination with a residential incandescent-type lamp fixture, said fixture comprising a base member having electrical conductors associated therewith, socket means vertically projecting from the upper portion of said base member and operatively receiving said electrical conductors, said fixture intended for operation with a lamp shade of predetermined dimensions and having a supporting frame means proximate the upper end thereof including a central member having provided therein an aperture of predetermined size, said fluorescent lamp conversion unit comprising:

lamp and lamp shade supporting means comprising a rigid hollow elongated member adapted to be vertically disposed and having at the lower end thereof an electrical adapter means adapted to mountably engage said socket means, said supporting means having at the upper end thereof a support member extending colinearly from said hollow elongated member and adapted to project through said aperture provided in said central member of said lamp shade frame means to support said lamp shade, a retaining member sized to cooperate with said support member to secure said frame means of said lamp shade to said hollow elongated member, housing means affixed to said rigid hollow elongated member proximate at least one end thereof, a fluorescent lamp of the compact type supported by said lamp and lamp shade supporting means, said lamp having an elongated envelope which has a double-U-bend to present a compact design thereby enabling said lamp to be enclosed by said lamp shade, said lamp including a pair of thermionic electrodes operatively mounted within said envelope proximate the ends thereof, a pair of lead-in conductors sealed through the ends of said envelope and connecting to each of said electrodes, said envelope closing a discharge-sustaining filling and having phosphor material carried on the interior surface thereof, the ends of said lamp terminating within said housing means, current carrying conductor means connected in circuit between said electrodes and said electrical adapter means, and lamp starting and ballasting means connected in circuit with said electrical conductors to operate said lamp.

2. The fluorescent lamp conversion unit of claim 1, wherein said socket means is a screw-type lamp socket.

3. The fluorescent lamp conversion unit of claim 2, wherein said electrical adapter means is a screw-type lamp base.

4. The fluorescent lamp conversion unit of claim 3, wherein said lamp starting and ballasting means is enclosed within the lamp and lamp shade supporting means.

* * * * *